United States Patent [19]

Flamand

[11] Patent Number: 4,586,304

[45] Date of Patent: May 6, 1986

[54] INSULATED SIDING AND METHOD FOR ITS APPLICATION

[76] Inventor: Robert Flamand, Box 1301, Hudson Bay, Saskatchewan, Canada, S0E 0Y0

[21] Appl. No.: 630,714

[22] Filed: Jul. 24, 1984

[51] Int. Cl.[4] ..... E04D 1/00

[52] U.S. Cl. ..... 52/309.8; 52/521; 52/533; 52/535; 52/540; 52/394; 52/748

[58] Field of Search ..... 52/309.9, 521, 535, 52/540, 518, 539, 394, 748, 533, 309.8

[56] References Cited

U.S. PATENT DOCUMENTS

| | | | |
|---|---|---|---|
| 2,231,007 | 2/1941 | Vane | 52/539 |
| 2,248,723 | 7/1941 | Robinson | 52/539 |
| 2,400,357 | 5/1946 | Krajci | 52/539 |
| 3,511,008 | 5/1970 | Grems et al. | 52/540 X |
| 4,292,776 | 10/1981 | MacDonald | 52/394 |
| 4,301,633 | 11/1981 | Neumann | 52/540 X |

FOREIGN PATENT DOCUMENTS

| | | | |
|---|---|---|---|
| 2623355 | 8/1977 | Fed. Rep. of Germany | 52/309.8 |

*Primary Examiner*—Carl D. Friedman
*Attorney, Agent, or Firm*—Stanley G. Ade

[57] ABSTRACT

An insulated siding panel comprises a panel of hardboard attached by adhesive to a polystyrene foam layer. The rear surface of the foam layer is parallel to the front face of the hardboard panel. The upper and lower faces have parallel V-shape with the upper face having the V inward for collection of moisture. The panels are installed by overlapping the hardboard of two adjacent panels to allow the foam layers to interlock leaving a space for a sponge layer. Channels are formed in the foam downwardly between the hardboard and the foam and across the bottom of the foam to provide an intercommunicating network to transmit moisture vapor. The panels can be nailed to the front face of a building using a spacer device to set the distance of the upper edge of the panel from the front face of the building to prevent compression of the foam.

18 Claims, 4 Drawing Figures

INSULATED SIDING AND METHOD FOR ITS APPLICATION

BACKGROUND OF THE INVENTION

This invention relates to an insulated siding and also to a method whereby such a siding can be attached to the outer face of a building.

Considerable attention is presently being given to methods of insulating buildings either from the point of view of the construction of a new building or in some cases more importantly from the point of view of adding insulation to already constructed buildings. One effective way by which this can be carried out is to add an additional layer of insulation material outside the shell of the existing building. Attempts have been made to develope a composite siding or sheathing material which provides a suitable layer of insulation while also having an outer surface which displays the necessary level of weather resistance. However success in this field has been substantially limited and the products presently on the market do not provide a desirable level of insulation and also have problems of attachment of the siding or sheathing to the outer surface of the building.

One particular problem which arises in relation to all insulating programs is that of the collection of moisture and the effect of the freezing of transmitted moisture within the structure of the building which can lead to serious problems particularly during the thaw-freeze cycle and in some cases to the accumulation of quite large quantities of ice.

Plastic foam insulation material has become widely used and a particularly effective material has been polystyrene foam as manufactured by a number of reputable and large manufacturers.

In addition various forms of siding material have been available including various plastics, wood, plywood, hardboard and aluminum and many of these are currently on the market simply as siding panels.

SUMMARY OF THE INVENTION

It is one object of the invention to provide a combined siding product incorporating an outer layer which provides the weather resistance and an inner rigid foamed plastic material which provides an insulating layer.

According to a first aspect of the invention, therefore, there is provided an insulated siding comprising a transversely elongate front facing panel having a character suitable to provide an exterior surface panel for a building and a layer of rigid plastic foam laminated to the rear surface thereof, a strip of the rear surface adjacent the bottom edge of the panel being free from foam whereby it can overlie the front surface of the next adjacent lower panel, the upper surface of the foam being inclined downwardly away from the upper surface of the panel and the lower surface of the foam being inclined in a substantially parallel direction to the upper surface whereby the lower surface of the foam of an upper panel engages the upper surface of the foam of a lower panel and acts to interlock the panels.

According to a second aspect of the invention there is provided an insulating siding comprising a transversely elongate front facing panel having a character suitable to provide an exterior surface panel for a building and a layer of rigid plastics foam laminated to the rear surface thereof, and a layer of sponge material arranged such that in use the sponge material lies between the upper surface of the foam of one panel and the lower surface of the foam of the next adjacent upper panel.

According to a further aspect of the invention there is provided an insulated siding comprising a transversely elongate front facing panel having a character suitable to provide an exterior surface panel for a building and a layer of rigid plastics foam laminated to the rear surface thereof, and means defining a plurality of channels through the siding at the junction between the foam and the panel.

According to a yet further aspect of the invention there is provided a method of applying to a building an insulated siding of the type comprising a transversely elongate front facing panel having a character suitable to provide an exterior surface panel for a building and a layer of rigid plastics foam laminated to the rear surface thereof, a strip of the rear surface adjacent the bottom edge of the panel being free from foam whereby it can overlie the front surface of the next adjacent lower panel, the method comprising affixing a first panel to the building, positioning a second panel on top of the first such that the bottom edge thereof overlaps the front surface of the first panel, positioning a rigid spacer strip between the top edge of the panel and the exterior surface of the building, fastening the panel adjacent the top edge thereof to the exterior surface of the building and removing the rigid spacer strip.

It is one advantage of the invention, therefore, that the outer panel providing the weather resistant layer can comprise a hardboard layer which is particularly suitable as a siding material with an interlocking technique between the panels and the inner foamed layer can comprise a polystyrene foam which also has an interlocking effect between the foam layer of one panel and the next adjacent foam layer. Thus the insulation material interlocks and provides a complete airtight layer on the outside surface of the building.

One particular problem which arises with materials of this type is that of the collection of moisture between the hardboard layer and the foam layer which causes the moisture to be collected within the hardboard layer and to cause serious damage to its structure. This has effectively prevented the use of hardboard or other moisture absorbent material immediately adjacent a moisture vapor barrier such as a foam insulation material.

The present invention provides a technique whereby this problem can be overcome in that the moisture vapor is properly ducted away from the damaging areas to positions where it can be expelled from between the panels. At the same time the ducts are prevented from transmitting air through the siding which of course would seriously reduce the insulation qualities of the product.

It is a yet further advantage of the invention that there is provided for the first time a technique for applying the panels including the foamed insulation material to the outer surface of the building. It is necessary for these to be applied accurately to provide a pleasing appearance and to ensure that the necessary air channels and moisture channels are not damaged or rendered ineffective.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
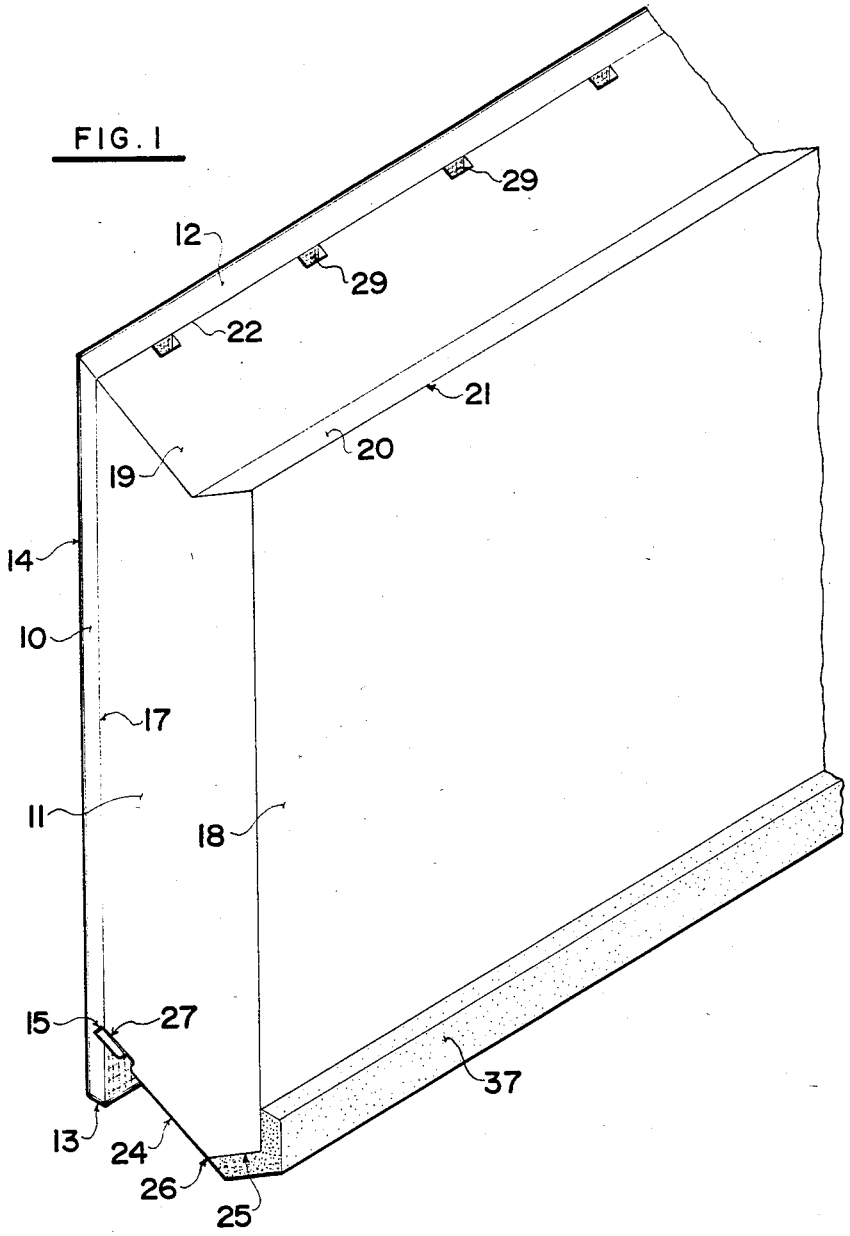
FIG. 1 is an isometric view of an insulated siding.

The insulated siding structure as shown in FIG. 1 comprises a hardboard panel 10 laminated to a layer 11 of rigid foam plastic material.

The hardboard panel 10 can be for example one foot in height and up to sixteen feet in length for application as the siding to the outside of a building. The hardboard panel can be for example ⅜ inch thick and of conventional construction. The top edge of the panel indicated at 12 is mitered from the outer face toward the inner face adjacent the layer 11 at an angle of the order of 30°. The lower edge indicated at 13 is formed by a rounded surface which may be half round or merely have chamfered edges so as to provide a pleasing appearance and to avoid sharp corners which can be easily damaged or chipped. The outer face of the panel 10 is coated in a baked paint finish which includes the lower surface 13 and terminates at the upper surface 12.

At a position spaced from but adjacent the lower surface 13 on the inside face of the panel is provided an elongate slot 15 which receives a plastic strip 16 along the full length of the panel. The angle of the slot and therefore of the strip is the same as the upper surface 12 so they lie parallel with the strip 16 inclined downwardly relative to the inside surface of the panel.

Figure 3:
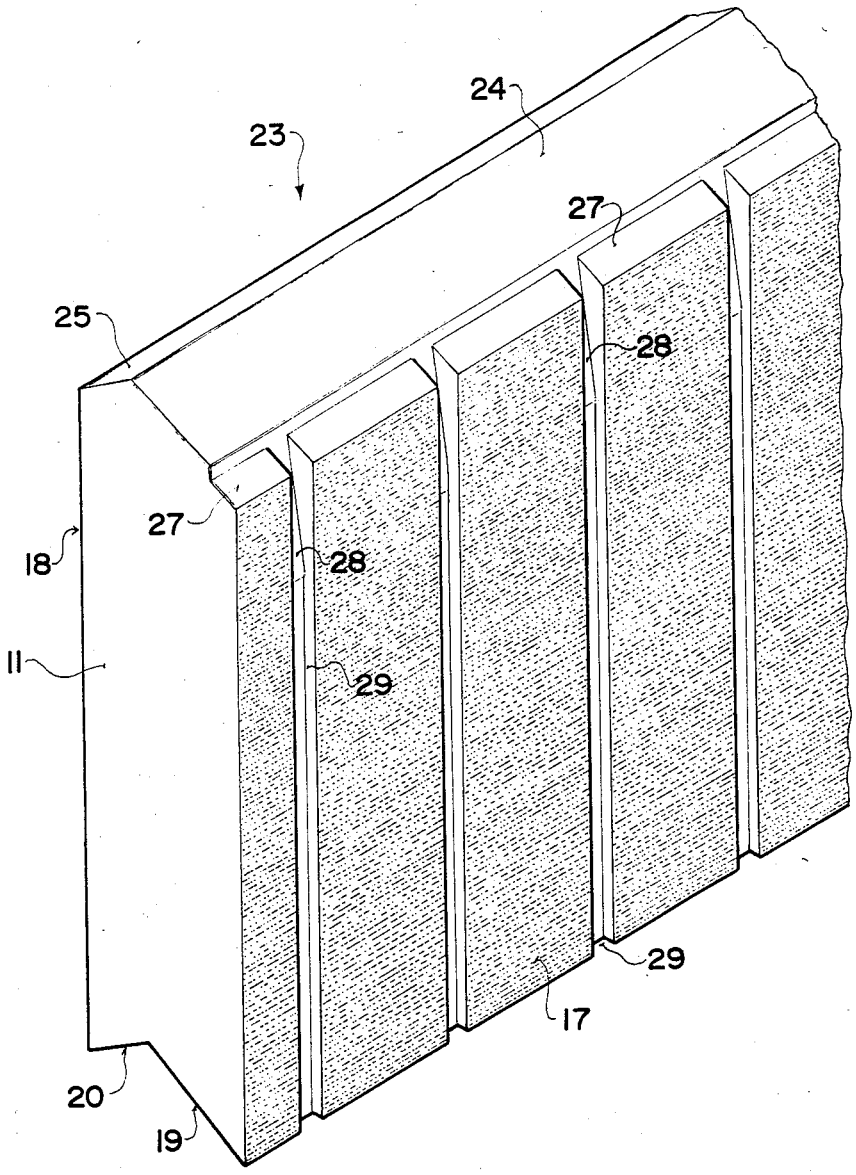
FIG. 3 is an isometric view of the foamed insulation layer of FIG. 1 as viewed from the other side and prior to the application of the panel.

The foamed plastic insulation layer 11 comprises preferable a polystyrene foam which is relatively rigid and which can be formed in layers of the order of three or four inches thick for lamination to the panel 10. The foam is formed by a suitable molding process into the shape illustrated in FIGS. 1 and 3. It will be appreciated that in FIG. 3 the foam layer 11 is inverted and viewed from the other side. The foam layer has a front face 17 and a rear face 18 which are parallel and flat. The upper surface of the layer is formed from two flat faces 19 and 20 which together form a V-shaped channel. The angle of the surface 19 to the front face 17 is the same angle as the angle of the upper surface 12 of the panel 10 so that when attached to the panel the surface 12 and 19 are effectively contiguous. The dimension of the surface 19 extending from the front face 17 towards the rear face 18 is of the order of ⅔ of the thickness of the layer that is approximately two inches in a layer of three inch thickness. The surface 20 is inclined relative to the rear face 18 at the same angle as the surface 19 so that the edge 21 between the surface 20 and the rear face 18 is at a lower height than the edge 22 between the surface 19 and the front face 17.

The lower face 23 of the layer 11 is again divided into two surfaces 24 and 25 which are parallel and of equal dimension to the surfaces 19 and 20 respectively. The dimensions and angle of the surface 24 are arranged such that the surface commences on the upper side of the strip 16 and extends downwardly to an edge 26 between the surface 24 and the surface 25 such that the edge 26 lies in the same horizontal plane as or slightly above the lower surface 13 of the panel 10.

The surface 24 has a first channel 27 recessed therefrom adjacent the inner face 17 and extending along the full length of the layer 11. As shown in FIG. 1, this channel or recess 27 is effectively rectangular in shape and is arranged adjacent the strip 16 so the strip 16 extends into the channel 27 but does not close it leaving a channel extending along the full length of the layer 11 adjacent the strip 16. A plurality of rectangular channels 29 is provided recessed into the front face 17 and extending substantially vertically down the front face from the upper surface 19 to the channel 27 in the lower surface 24. The upper end of the channels 29 is visible in FIG. 1. The lower end of the channel 29 is flared as at 28 so as to accommodate any ice which may form in moisture collecting at the bottom of the channel 29.

In order to laminate the layer 11 to the panel 10, the front face 17 of the layer is roughened for example by engagement with a pinned wheel to form a suitable surface for adhesion to the panel 10. A layer of adhesive for example a foamed moisture-proof adhesive is then applied to the rear surface of the panel 10 for attachment of the layer 11. The rear surface of the panel can also be painted or otherwise coated at least at the lower edge which is exposed in order to prevent the entry of moisture. Suitable adhesive will of course be well known to one skilled in the art. The recessed channels 29 therefore do not contact the rear surface of the panel 10 and therefore remain as channels passing between the panel and the front face 17 of the layer 11. The position of the layer relative to the panel is arranged such that the upper surface 19 is contiguous with the surface 12 while the lower surface 24 just contacts the upper edge of the strip 16.

A number of points will be noted from the structure of the insulated siding as described above. Firstly the channels 27 and 29 provide a communication system for vapor and gases through the panel from the top to the bottom and also along the panel.

Secondly the edges 25 and 21 which constitute the uppermost and lowermost edges of the foam layer 11 are within the confines of the upper edge and lower edge of the panel 10 and thus are effectively protected by the solid panel 10 and can be stacked and packaged without damage.

The hardboard layer 10 is protected by a moisture vapor barrier formed by the adhesive and/or coating on the rear surface and by a baked on paint finish on the front surface. Effectively therefore, moisture cannot penetrate into the hardboard layer and is confined to running down the outer face or the inner face through the channels 29.

The front and rear faces of the insulated siding formed by the front face of the panel 10 and the rear face 18 of the layer 11 are parallel thus enabling ready packaging of a number of the sidings in rectangular structure.

Figure 2:
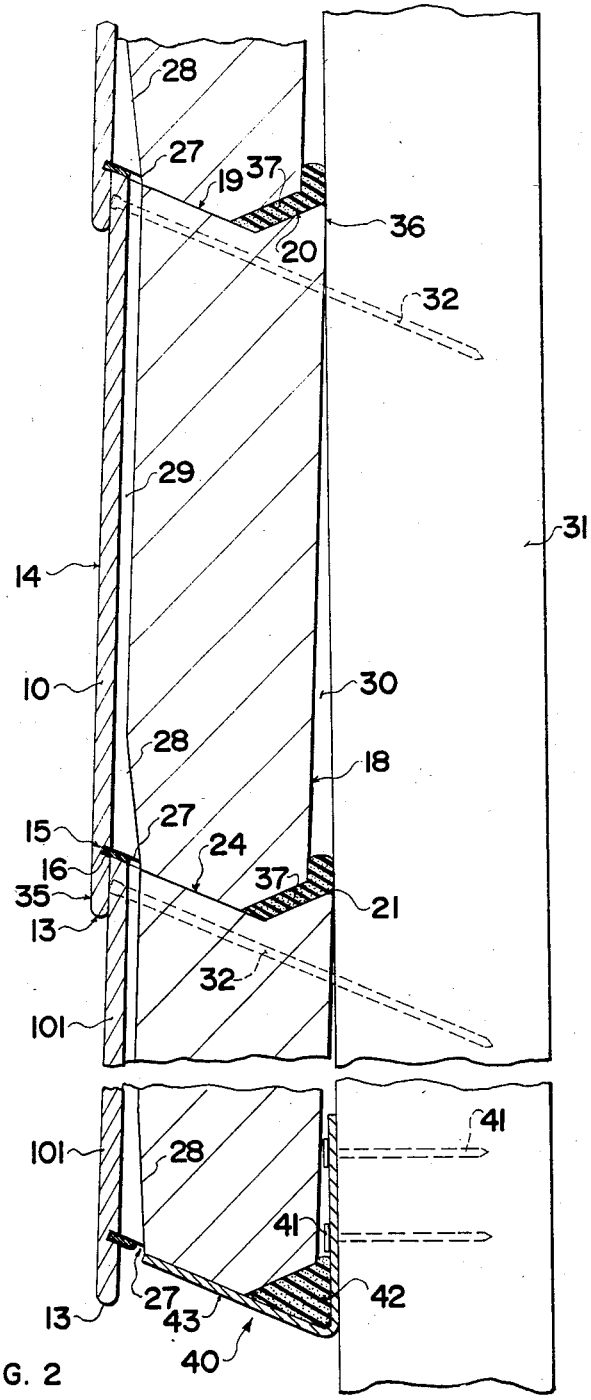
FIG. 2 is a cross sectional view through a wall including a number of the siding structures of FIG. 1.
Figure 4:
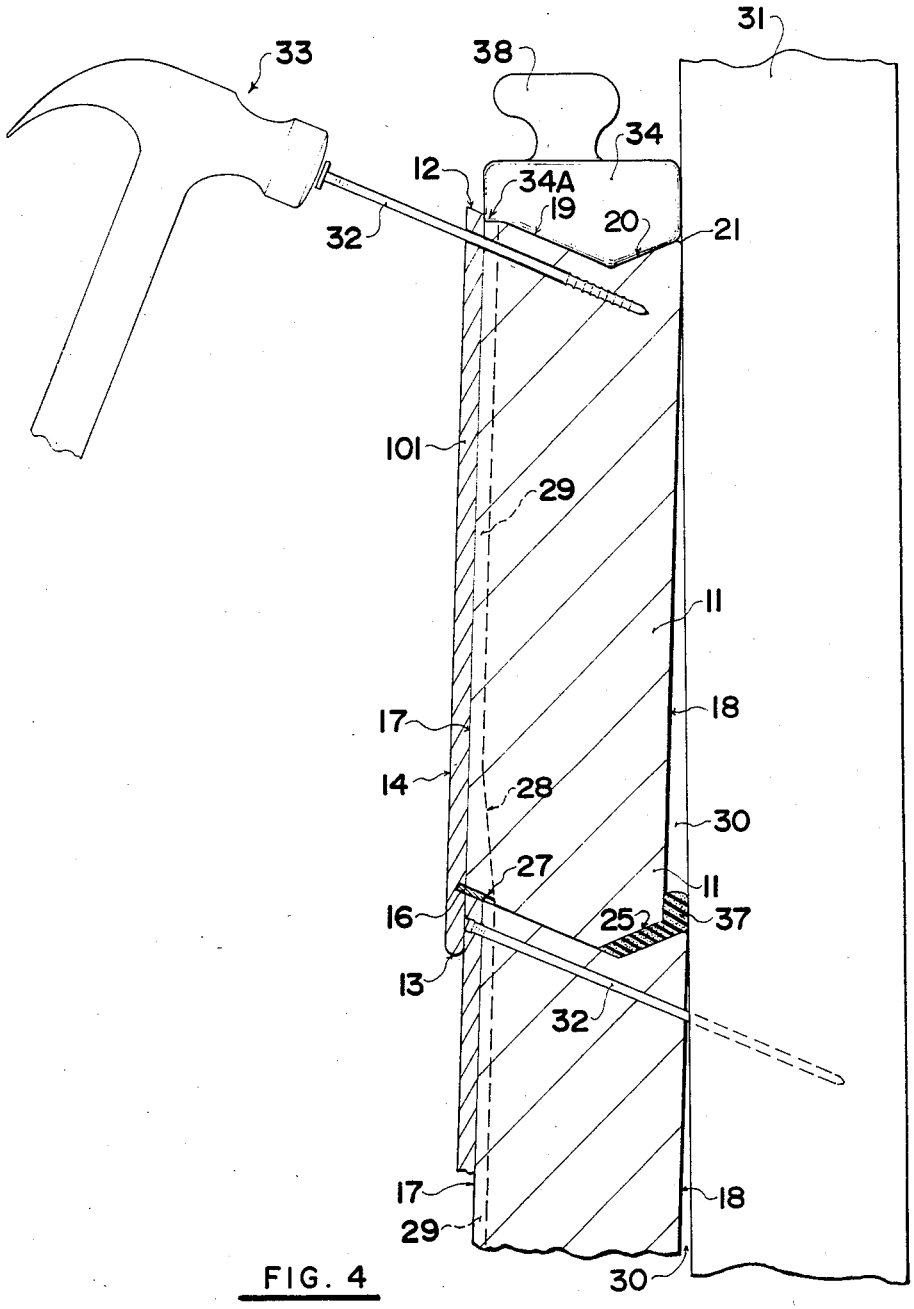
FIG. 4 is a cross sectional view similar to that of FIG. 2 showing the application of the siding structure of FIG. 1 to the wall and including a tool specifically designed for the purpose.

Turning now to the assembled structure as shown in FIG. 2 and the method of assembly as shown in FIG. 4, firstly an angle bracket 40 is attached to the wall to be covered by nails 41. The bracket 40 extends along the the full length of the intended panel. A triangular foam piece is then inserted as indicated at 42 to fill the space beneath the surface 25. The angle of the support arm 43 of the bracket is arranged so that it lies coincident with the surface 24.

A lowermost siding is applied to the flat outer face of a building. The outer face of the building is indicated at 30 and including a vertical stud 31 forming a framework for the building. The outer face 30 may be formed by some form of paneling or may be the original siding of the building or may comprise just the studs 31 with an intervening insulation layer. In any event a first insulated siding indicated at 101 is attached to the outer face. The fastening for the sidings can be for example spikes or nails which are simply hammered into the stud 31 at a position adjacent the upper edge of the siding. In order to ensure that the rigid foam layer 11 is not squashed or distorted by the injection of the spike or nail indicated at 32 which can be done manually or by a power tool for example by the hammer indicated schematically at 33, a spacer member 34 is positioned between the outer surface 30 of the building, the upper surface of the siding and the top inner edge of the panel 10. The spacer 34 comprises a rigid body with the lower surface shaped including a lip 34A to fit into the space defined by those surfaces and extending along a length of the siding. For example the length could be of the order of four feet so that the spacer bridges a number of studs 31 and provides a straight line regardless of any misalignment of one or two of the studs 31. The spacer 34 thus accurately spaces the rear surface of the panel 10 relative to the surface 30 regardless of any force applied to the front surface of the panel by the spike 32 or the hammer 33. The position of the spike is arranged such that when the next above panel is applied on top of the first panel the overhang portion indicated at 35 in FIG. 2 covers the head of the spike as well as the other edge of the panel 10. The spike is then angled slightly downwardly so as to pass through the foam below the upper surface and through the rear face 18 of the foam into the stud 31.

It will be noted from FIG. 2 that when the next above siding is applied on top of the first, the panel 10 of the siding overlies the panel 10 of the lower siding and extends slightly in front thereof so that the upper edge 12 of the panel of the lower side engages the strip 16 of the upper siding. In addition, the upper surface of the foam layer 11 engages the lower surface of the foam 11 of the upper side thus forming an interlock. In view of the fact that the upper siding is spaced slightly outwardly from the lower siding by the overlap of the panel 10, the lower surface 25 is spaced from the upper surface 20 by a distance approximately equal to the thickness of the panel 10. In addition, the rear face 18 of the layer 11 is spaced from the front face 30 of the building again by a distance equal to the thickness of the panel 10 with the rear face 18 then inclined rearwardly towards the building so that it contacts the outer face of the building substantially in line contact with the top edge of the rear surface 18 indicated at 36. The space between the surfaces 25 and 20 is completely filled with a sponge or flexible foam layer 37 which acts to prevent the passage of air through between the panels.

The sponge strip 37 is shaped so that it completely fills the space beneath the surface 25 and it turns upwardly in L-shape along the back of the panel to form an L-shape in cross-section. Thus the sponge strip contacts the full extent of the surface 20 and part of the surface 19.

The sponge strip 42 beneath the lowermost panel is triangular shaped in order to completely fill in a similar manner the space beneath the surface 25 bearing in mind that the angle bracket 40 does not include the upwardly inclined surface 20 in view of the difficulty of manufacture of a bracket of that shape.

The sponge 37 can either be supplied on site for installation as part of one of the panels that is adhered to either the surface 20 or the surface 25 or it can be supplied as a separate item for introduction during the assembly.

The spacer 34 includes a handle or handles 38 on its upper surface so that it can be readily lifted away from the installed panel so the next above panel can be placed in position as shown in FIG. 2.

The channels 29 can be arranged so they are lined between one siding and the next above siding but this is not essential in view of the channel 27 which extends across all the channels 29 thus effectively forming a communicating network of channels which allow the moisture to escape. The spline or strip 16 takes some of the weight or forces between the two adjacent sidings and therefore tends to form an airtight seal between the top of one panel and the next adjacent panel. Other parts of the weight are taken by the spike 32 and yet further parts by the interconnection between the foam layers 11. The whole structure, therefore, provides an interlocking system which provides structural strength for the building rather than applying weight to the building and therefore the siding can be applied to any building without concern for its withstanding additional forces.

The adhesive layer between the panel 10 and the foam 11 can be applied with a comb like object thus providing horizontal ridges in the adhesive. These ridges can to some extent provide a plurality of closely spaced horizontal moisture vapor transmission channels to yet further add to the network of moisture communication channels throughout the siding.

Although not preferred, the hardboard panel 10 can be replaced by an aluminum sheet with interlocking clip arrangements thus providing an overlapping system similar to that shown in FIGS. 2 and 4.

The present invention, therefore, provides a new construction material which is relatively inexpensive to manufacture and inexpensive to apply to a building. It can be quickly and easily installed by relatively unskilled labour. It provides a wall covering that affords excellent thermal and acoustic insulation. It overcomes the mechanical and physical disadvantages of conventional plastic foam boards. It provides an effective air seal while allowing the transmission of moisture through a communication network within and between each panel. It provides an effective interconnection technique between each siding and the next adjacent siding. The foam insulation material provides a continuous layer which interconnects one with the next to minimize thermal bridging which can occur where wood and metal members of a structure are interconnected. It provides a very high insulating value which can be of the order of R-15 or greater.

The overlapping edge between the panels 10 adequately protects the joins against infiltration of water. Hardboard sheets with a thickness of at least $\frac{3}{8}$ inch are preferred because hardboard has acceptable stiffness, low moisture content with minimum expansion and acceptable weight to strength ratios. It is also readily available and relatively cheap. Polystyrene foam is the preferred foam insulation layer and this can be of the type manufactured under the trade mark STYROFOAM SM which exhibits very low thermal conductivity over a very long time span.

The arrangement of the nail 32 parallel to the surface 19 that is inclined downwardly at an angle enables the siding panel to be firmly attached to the building. Specifically, the downward direction initially provides a pulling force on the panel downwardly against the next adjacent lower panel so as to hold the panels as tight as possible against one another. In addition, in order for the panel to become loose by riding up away from the next adjacent lower panel, it has to bend the nail which in turn reduces the distance between the head of the nail and the outer surface of the building thereby squeezing the upper edge of the panel. Thus, once installed, the forces on the panels work together to hold the panels in place and to hold the hardboard panel against the foam insulation layer.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. An insulated siding for attachment to an outer face of a building comprising a transversely elongate front facing panel having front and rear surfaces and top and bottom edges and a character suitable to provide an exterior surface panel for a building and a layer of rigid plastics foam having a front surface laminated to a rear surface thereof and a rear surface spaced therefrom and parallel to the front surface, a strip of the rear surface adjacent the bottom edge of the panel being free from foam whereby it can overlie the front surface of the next adjacent lower panel, an upper surface of the foam being V-shaped in cross section to provide a portion inclined downwardly away from the upper edge of the panel and a portion adjacent the rear surface of the foam inclined upwardly thereto, a lower surface of the foam defining a downwardly inclined portion and an upwardly inclined portion substantially parallel to an coextensive with those of the upper surface whereby the lower surface of the foam of an upper panel engages the upper surface of the foam of a lower panel and acts to interlock the panels the panel having a thickness that the overlaying bottom edge thereof causes the formation of a first space between the upwardly inclined portion of the upper surface of the lower panel and the upwardly inclined portion of the lower surface of the upper panel and causes the rear surface of the foam to engage the outer face of the building in line contact across an upper edge of the rear surface defining a second space between the lower edge of the rear surface and the outer face of the building and a sponge material in said first and second spaces.

2. An insulated siding according to claim 1 including a rigid strip secured to the rear surface of the panel in contact with the bottom surface of the foam for engaging the top edge of the panel of the next adjacent lower siding.

3. An insulated siding according to claim 2 wherein the rigid strip extends outwardly from the rear surface of the panel adjacent the bottom surface of the foam.

4. An insulated siding according claim 1 wherein the top surface of the panel is parallel to the top surface of the foam.

5. An insluate siding according to claim 1 wherein the panel is formed of hardboard with a paint finish on the front surface thereof.

6. An insulated siding according to claim 1 wherein the lower surface of the foam is inclined downwardly to an apex which lies on a level at least as high as the bottom edge of the panel whereby the upper and lower extents of the foam lie within the bounds of the panel so as to be protected by the panel.

7. An insulated siding according to claim 1 wherein the foam is laminated to the panel by an adhesive which forms a moisture vapor barrier between the foam and the panel.

8. An insulated siding according to claim 1 including a channel formed along the junction between the upper surface of the foam of a lower panel and the bottom surface of the foam of an upper panel, the channel being formed at the rear of the panel whereby to allow the communication of moisture vapor along the junctions between adjacent panels.

9. An insulated siding according to claim 8 wherein the channel is formed at the junction between the panel and the bottom surface of the foam.

10. An insulated siding according to claim 8 including a plurality of channels arranged between the panel and the foam and passing downwardly from the upper surface of the siding to the lower surface thereof.

11. An insulated siding for attachment to an outer face of a building comprising a transversely elongate front facing panel having front and rear surfaces and top and bottom edges and a character suitable to provide an exterior surface panel for a building and a layer of rigid plastics foam having a front surface laminated to a rear surface thereof, and a rear surface spaced therefrom, a layer of sponge material arranged such that in use the sponge material lies between the upper surface of the foam of one panel and the lower surface of the foam of a next adjacent upper panel and means defining a channel along the junction between the upper surface of the foam of said one panel and the lower surface of the foam of said next adjacent upper panel, said channel defining means being arranged to form said channel at said rear surface of said panel whereby to allow the communication of moisture vapour along the junctions between adjacent panels.

12. An insulated siding according to claim 11 including a plurality of channels arranged between the panel and the foam and passing downwardly from the upper surface of the siding to the lower surface thereof.

13. A method of applying to an outer face of a building an insulated siding of the type comprising a transversely elongate front facting panel having front and rear surfaces and top and bottom edges and a character suitable to provide an exterior surface panel for a building and a layer of rigid plastics foam laminated to the rear surface thereof, a strip of the rear surface adjacent the bottom edge of the panel being free from foam whereby it can overlie the front surface of the next adjacent lower panel, the method comprising affixing a first panel to the building, positioning a second panel on top of the first such that the bottom edge thereof overlaps the front surface of the first panel, positioning a rigid spacer strip between the top edge of the panel and the exterior surface of the building, fastening the panel adjacent the top edge thereof to the exterior surface of the building and removing the rigid spacer strip.

14. A method according to claim 13 wherein an upper surface of the foam is V-shaped in cross section to define a portion inclined downwardly away from the upper edge of the panel and a portion adjacent the rear surface of the foam inclined upwardly thereto, a lower surface of the foam defining a downwardly inclined portion and an upwardly inclined portion substantially parallel to and coextensive with those of the upper surface whereby the lower surface of the foam of an upper panel engages the upper surface of the foam of a lower panel and act to interlock the panels.

15. A method according to claim 14 wherein the positioning of the second panel on the first panel causes the formation of a first space between the upwardly inclined portion of the upper surface of the first panel and the upwardly inclined portion of the lower surface of the second panel and wherein a layer of a sponge material is positioned in said first space.

16. A method according to claim 13 wherein the second panel includes a rigid strip secured to the rear surface thereof parallel to the bottom surface of the foam thereof for engaging the upper surface of the first panel.

17. A method according to claim 13 wherein the panel is formed of hardboard with a paint finish on the front surface thereof.

18. A method according to claim 13 wherein the rear surface of the foam of the second panel is parallel to the front surface of the second panel whereby with the panel overlapped with the first panel, the rear surface of the foam of the second has only line contact along the top edge thereof with said outer face of the building.

* * * * *